US010843892B2

(12) United States Patent
Van Deurse et al.

(10) Patent No.: US 10,843,892 B2
(45) Date of Patent: Nov. 24, 2020

(54) WINDING CORE END PROTECTOR

(71) Applicants: Michael Van Deurse, Norton, MA (US); Greg Sandford, Brockton, MA (US)

(72) Inventors: Michael Van Deurse, Norton, MA (US); Greg Sandford, Brockton, MA (US)

( * ) Notice: Subject to any disclaimer, the term of this patent is extended or adjusted under 35 U.S.C. 154(b) by 226 days.

(21) Appl. No.: 16/126,013

(22) Filed: Sep. 10, 2018

(65) Prior Publication Data

US 2019/0077629 A1 Mar. 14, 2019

Related U.S. Application Data

(60) Provisional application No. 62/557,328, filed on Sep. 12, 2017.

(51) Int. Cl.

| | |
|---|---|
| ***B65H 75/28*** | (2006.01) |
| ***B65H 18/00*** | (2006.01) |
| ***B65H 75/10*** | (2006.01) |
| ***B65H 75/18*** | (2006.01) |

(52) U.S. Cl.

CPC ..... *B65H 75/28* (2013.01); *B65H 18/00* (2013.01); *B65H 75/10* (2013.01); *B65H 75/187* (2013.01); *B65H 2301/41346* (2013.01)

(58) Field of Classification Search

CPC ..... B65H 75/28; B65H 75/10; B65H 75/187; B65H 18/00; B65H 2301/41346

See application file for complete search history.

(56) References Cited

U.S. PATENT DOCUMENTS

| | | | | |
|---|---|---|---|---|
| 839,378 | A | 12/1906 | Gately | |
| 911,006 | A | 1/1909 | Gately | |
| 1,137,470 | A | 4/1915 | Elixman | |
| 1,358,531 | A | 11/1920 | Dodge | |
| 1,651,705 | A | 12/1927 | Hill | |
| 1,687,586 | A | 10/1928 | Parker | |
| 1,929,036 | A | 10/1933 | Reagles | |
| 2,076,870 | A | 4/1937 | Taylor | |
| 3,700,099 | A * | 10/1972 | Heroux | B65D 59/02 206/415 |
| 3,713,601 | A | 1/1973 | Buhrman et al. | |
| 4,198,008 | A | 4/1980 | Krautwaid | |
| 4,208,790 | A | 6/1980 | Eglinton | |
| 4,834,314 | A | 5/1989 | Powel et al. | |

(Continued)

FOREIGN PATENT DOCUMENTS

| | | |
|---|---|---|
| DE | 4413810 A1 | 10/1994 |
| EP | 2 616 375 B1 | 2/2016 |
| EP | 2 635 514 B1 | 11/2016 |

*Primary Examiner* — William A. Rivera
(74) *Attorney, Agent, or Firm* — John P. McGonagle

(57) ABSTRACT

A core end protector comprised of a shock absorber and an annular, rigid attachment section that is attached to each end of a cardboard tissue core is provided. The core end protectors are securely mounted on the ends of the core. The outer diameter of the core end protector matches the outer diameter of the core. The inner diameter matches the inner diameter of the core. The core end protectors are made both with a rigid base section that mates to the core end face and a softer, shock absorbing section that comes in contact with external forces and impact loads. One single material or a plurality of materials may be used.

1 Claim, 9 Drawing Sheets

(56) References Cited

U.S. PATENT DOCUMENTS

| | | | | |
|---|---|---|---|---|
| 5,232,092 | A | 8/1993 | Chamberlin et al. | |
| D347,567 | S | 6/1994 | Duffy | |
| 5,377,831 | A | 1/1995 | Crooks | |
| 5,381,984 | A * | 1/1995 | Hindsgual | A47K 13/145 242/613.5 |
| 5,393,010 | A * | 2/1995 | Renck | B65H 75/187 242/613.5 |
| 5,413,220 | A | 5/1995 | Sirianni | |
| 5,441,780 | A | 8/1995 | Bushell et al. | |
| 6,732,964 | B2 | 5/2004 | Couchey | |
| 6,783,833 | B2 | 8/2004 | Bordner et al. | |
| 7,204,451 | B2 | 4/2007 | van de Camp | |
| 7,287,721 | B2 | 10/2007 | Quick et al. | |
| 9,415,971 | B2 | 8/2016 | Duchanois et al. | |
| 2004/0056141 | A1 | 3/2004 | Quick | |
| 2013/0270138 | A1 | 10/2013 | Weber et al. | |
| 2019/0168990 | A1 * | 6/2019 | Boadas Matamala | B65H 75/10 |

* cited by examiner

WINDING CORE END PROTECTOR

CROSS-REFERENCE TO RELATED APPLICATIONS

Applicants claim the priority benefits of U.S. Provisional Application No. 62/557,328, filed Sep. 12, 2017.

BACKGROUND OF THE INVENTION

This invention relates to core tubes for a roll of paper or sheet material, and in particular, to protective ring elements attachable to core ends.

It is common in the tissue manufacturing industry for mills to wind tissue on 8" to 16" diameter by 100" long cardboard cores to create parent rolls that are later transported from the papermaking portion of the mill to the converting area of the mill. In converting these parent rolls (weighing up to 7,700 pounds and having up to an 85" diameter) are then loaded onto unwind core plugs or core chucks and converted down into small rolls or even end product (packaged toilet paper, paper towels, etc.). After a parent roll is unwound, the remaining empty core can then be re-used on a papermaking machine provided the core is not damaged.

Applicants have found that there is a limited number of re-uses that a core can go through before it is damaged beyond usability. In some mills, the cores are re-used 4 to 7 times. In other mills, the cores can only be used once before needing to be replaced. Damage to a core is caused by multiple factors that all interplay. Examples of damage causality include the following.

A. Damage is often started if the parent roll 1 is wound slightly off center to the core 10 wherein a portion 14 of the core protrudes beyond the end face 2 of the roll. See FIG. 1. When this parent roll is transported from the winder to a storage or converting area of the mill, it is done using a forklift truck with roll clamp attachment (clamp truck). When the clamp truck sets down the roll, there can be a slight drop. e.g., 1". If the end 11 of a cardboard core 10 is protruding beyond the bottom face 2 of a wound parent roll 1, the impact stress of this drop will be focused on the core end 11, causing deformation, layer delamination, tearing and other damage. This presents an initial weakening of the core end.

B. When the "weakened" parent core 10 is unwound from core plugs/chucks 5 on a converting machine, additional damage can occur causing a "flaring" or "belling" type deformation 17 on the end 11 of the core 10. See FIG. 2. The more the core end 11 is weakened, the more flaring will take place. This flaring is cause by a stress concentration on the inside diameter surface 13 of the core 10 right at the core end 11 where contact is made with the core plug/chuck 5 under heavy cyclic loading as the roll 1 unwinds.

C. Some converting machines unwind using an axial side pressure C from the core plugs/chucks 5 to secure the core 10 and parent roll 1 during the unwind operation. See FIG. 3. The recommended limit on side force is 60% of the roll weight. This means that 4,620 pounds is generally the highest side force. This side force C crushes the core ends 11 inwards, causing further core end weakening and higher susceptibility to flaring. Friction between the cardboard core end face 11 and the steel plate 6 of the core plug/chuck 5 when the core slips also causes cardboard delamination and weakening.

D. After a parent roll is unwound, it is removed from the converting machine and brought to a separate "slabbing" operation where operators remove any remaining layers of tissue from the core 10 using knife blades 8 running across the core outer surface 12. Additional core weakening and delamination occur when the knife blades score the core surface during these cuts 15, especially if a knife blade runs off the end of the core and creates damage to the core end 11. See FIG. 4. This can cause material splitting and tearing to the core end.

E. Additional handling of the core until it is brought back to the papermaking winder can also cause further damage. One example is when a winding shaft/reel is misaligned before being inserted back into the core with a hydraulic shaft inserter. Another similar example is when the core is misaligned before unwind stand core chucks are hydraulically inserted or before core plugs are inserted into the core. These misalignments can cause core end deformation, delamination and tearing.

F. When a core is loaded onto a reel spool and then placed on the papermaking drum winder, it is done so with the winding drum rotating at high speed. It is therefore critical for the outer diameter 16 of the core 10 to be uniform. If the core end flaring 17 is too great beyond the outside diameter of the core, and past a usable limit 18, especially if it is scored, split or torn at the core end, in combination with too much flaring, it will cause the core to tear apart once it comes in contact with the high speed winding drum. See FIG. 5. This is the ultimate cause of failure of cores at a tissue mill/factory and what limits the number of safe core re-uses.

SUMMARY OF THE INVENTION

The present invention addresses the factors causing core end damage. Specifically, the present invention is a core end protector comprised of a shock absorber and an annular, rigid attachment section that is attached to each end of a cardboard tissue core. The invention end protectors are securely mounted on the ends of the core using any variety of means including fasteners, and adhesive. The outer diameter of the core end protector does not extend beyond the outer diameter of the core. The inner diameter does not extend beyond the inner diameter of the core. The invention core end protectors are made both with a rigid base section that mates to the core end face and a softer, shock absorbing section that comes in contact with external forces and impact loads. One single material or a plurality of materials can be used.

In a preferred configuration, the rigid base section may be made from metal or a high durometer rigid polymer. The base section is intended to spread out an impact load to a larger area on the cardboard core, thereby reducing stress concentrations which cause core deformation, delamination and tearing. The shock absorbing section is made from a softer durometer polymer or elastomeric material (such as urethane or rubber) characterized by surface toughness, overall flexibility upon impact, and high resistance to material creep and compression set under load. If dissimilar materials are used for the base section and shock absorbing section, the shock absorbing section can be bonded to the rigid base section. If molded from similar materials, they can be made in the same mold using two different durometer compounds. The shock absorbing section can be uniform or have a material geometry designed like "nubs" which each flex individually upon impact and then return to its original shape. The fasteners hold the rigid base section directly to the core end, but do not come in contact with the shock absorbing section.

The present invention addresses the multiple problems associated with handling tissue rolls.

A. When a parent roll is dropped or set down from a clamp truck, the impact of the fall will now be absorbed by the invention end protector and distributed more uniformly to the cardboard core material. Any impact will always cause some material deformation. Cardboard cores are an inelastic material, so any deformation they see will become permanent damage. The invention end protector shock absorbing material is elastic and designed to take the deformation and then later spring back. This reduces the amount of permanent deformation experienced by the cardboard core. The core stays stronger and less susceptible to flaring later in the unwind process.

B. The flaring on a cardboard core occurs due to stress concentrations where the core contacts the core plug. With the invention end protector, the location of this stress concentration is now made on an elastomeric material that is less likely to permanently deform upon the cyclic loading process of an unwind. This minimizes the flaring taking place. The invention rigid base increases the hoop strength of the core end and further reduces flaring from occurring.

C. The surface contact from axial side pressure will be taken up by an end protector material with external surface toughness and a lower coefficient of friction. The end protector material will be less susceptible to damage from axial side pressure factors and will protect the core material itself from being damaged.

D. During the slabbing operation, when the slabbing knife is cut down to the end of the core, it will encounter an end protector rigid base section with high surface toughness. This will substantially reduce the issue of the core outer surface splitting and tearing at the core end.

E. Further general handling of empty cores having invention end protectors will be less likely to damage the core ends. This is especially true if a reel spool, core chuck or core plug is not accurately lined up with the core before automated insertion. With the invention end protectors, there is a better chance of guided alignment without damage to the core end.

These together with other objects of the invention, along with various features of novelty which characterize the invention, are pointed out with particularity in the disclosure annexed hereto and forming a part of this disclosure. For a better understanding of the invention, its operating advantages and the specific objects attained by its uses, reference should be made to the accompanying drawings and descriptive matter in which there is illustrated a preferred embodiment of the invention.

DETAILED DESCRIPTION OF INVENTION

Figure 1:
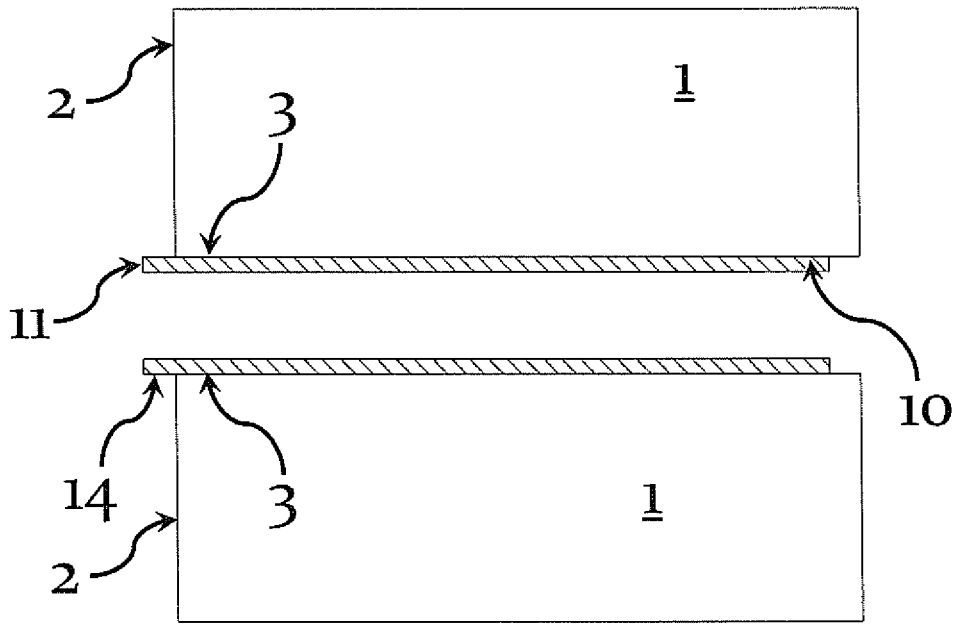
FIG. 1 is a cross-sectional view of a tissue roll off center on a cardboard core.
Figure 2:
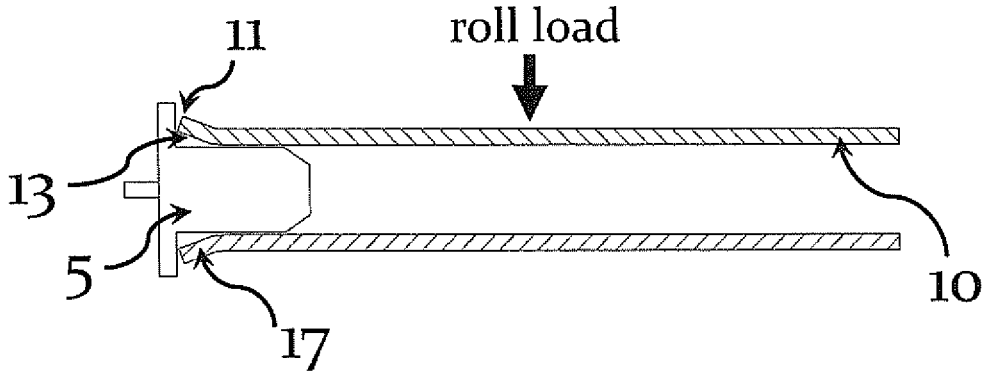
FIG. 2 is a cross-sectional view of a cardboard core with a core plug.
Figure 3:
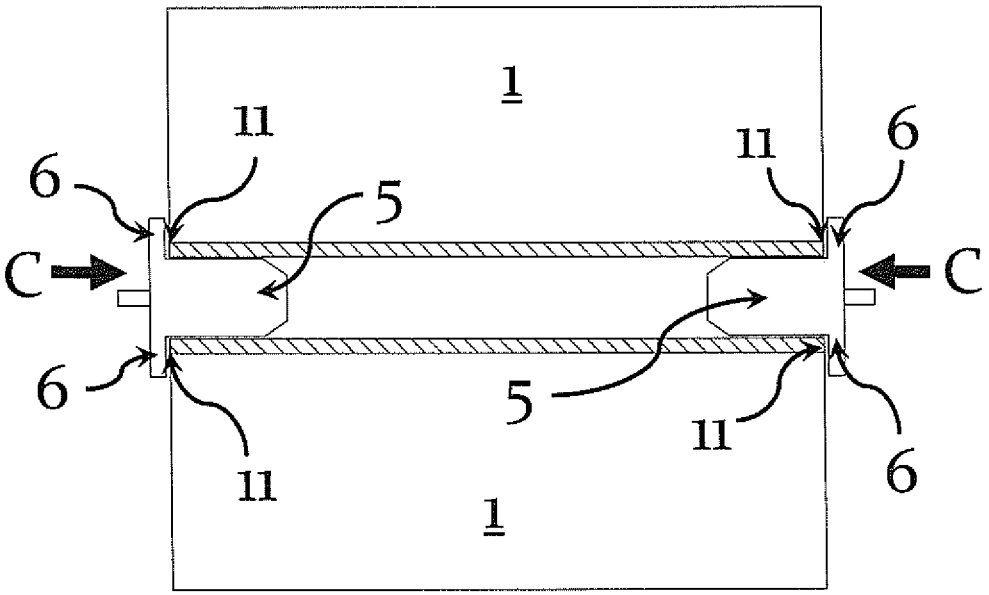
FIG. 3 is a cross-section al view of a tissue roll on a cardboard core with core plugs.
Figure 4:
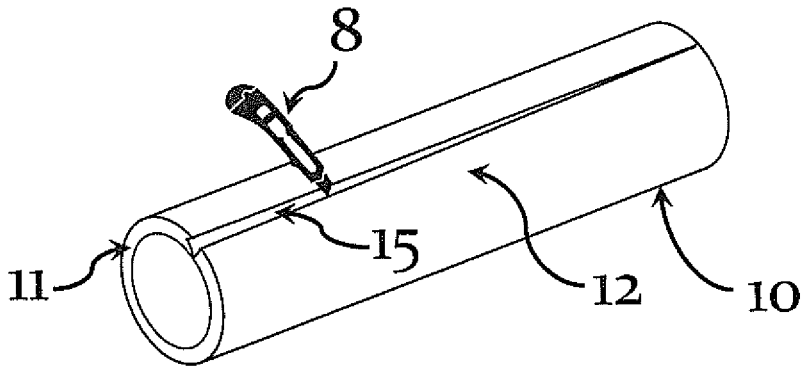
FIG. 4 is a perspective view of a cardboard core scored with a knife.
Figure 5:
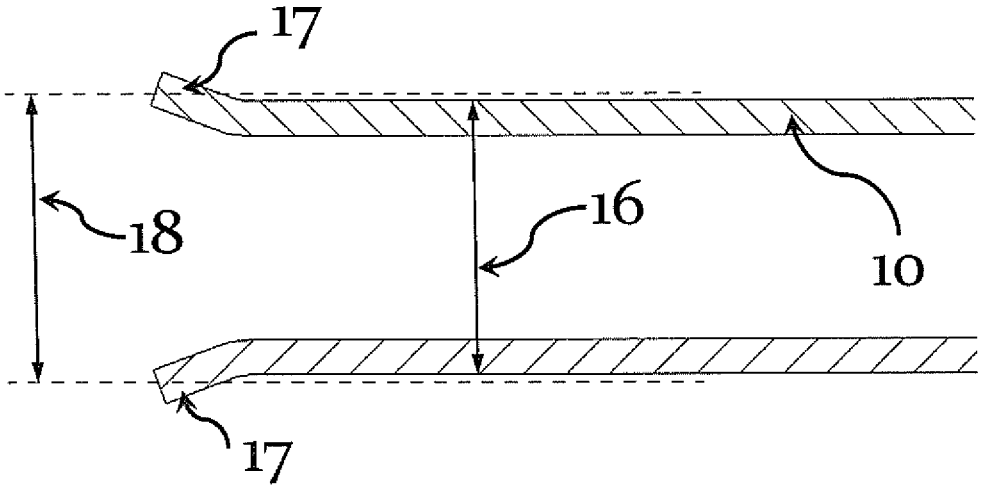
FIG. 5 is a cross-sectional view of a cardboard core with flared ends.
Figure 6:
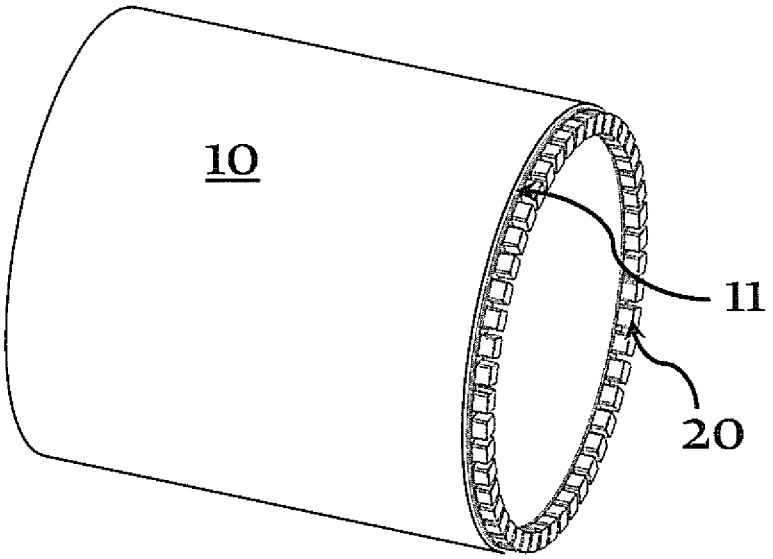
FIG. 6 is a side perspective view, partly in section, of a core end protector attached to the end of a cardboard core.
Figure 7:
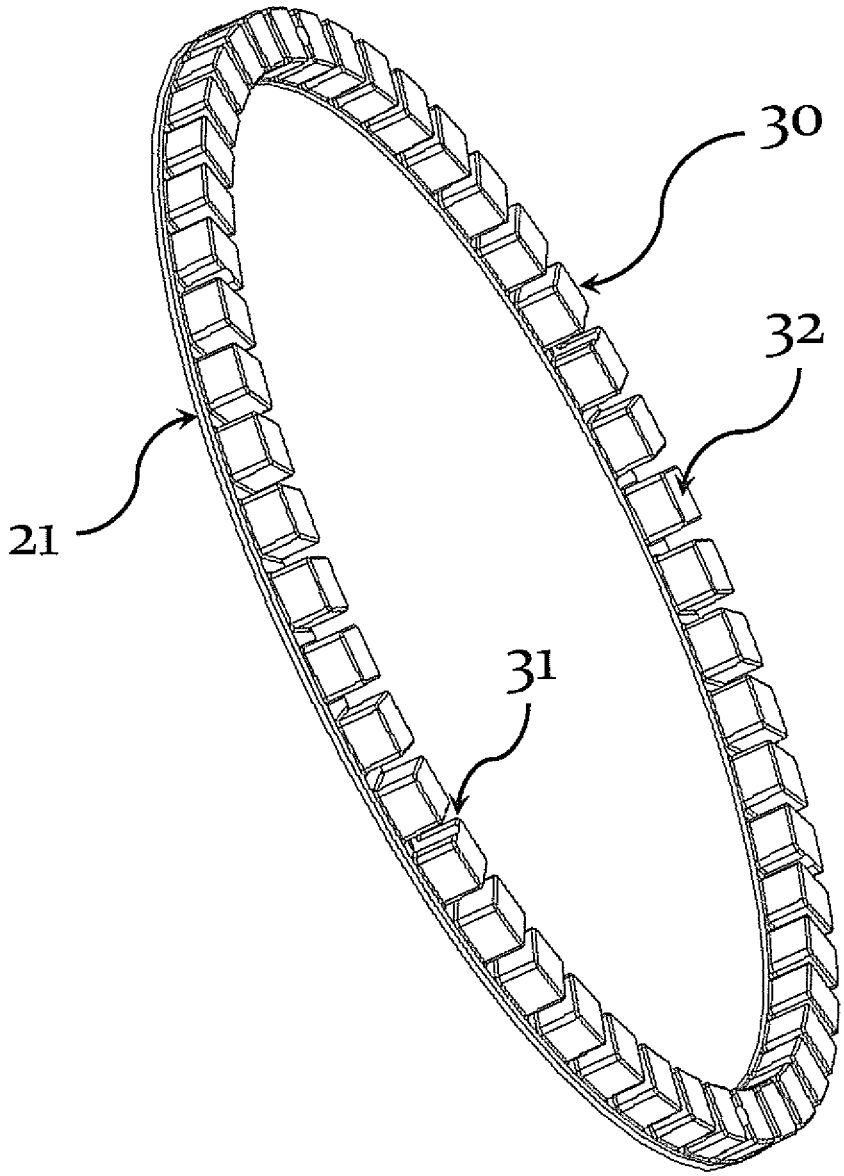
FIG. 7 is a perspective view of a core end protector using individual nubs for shock absorption.
Figure 8:
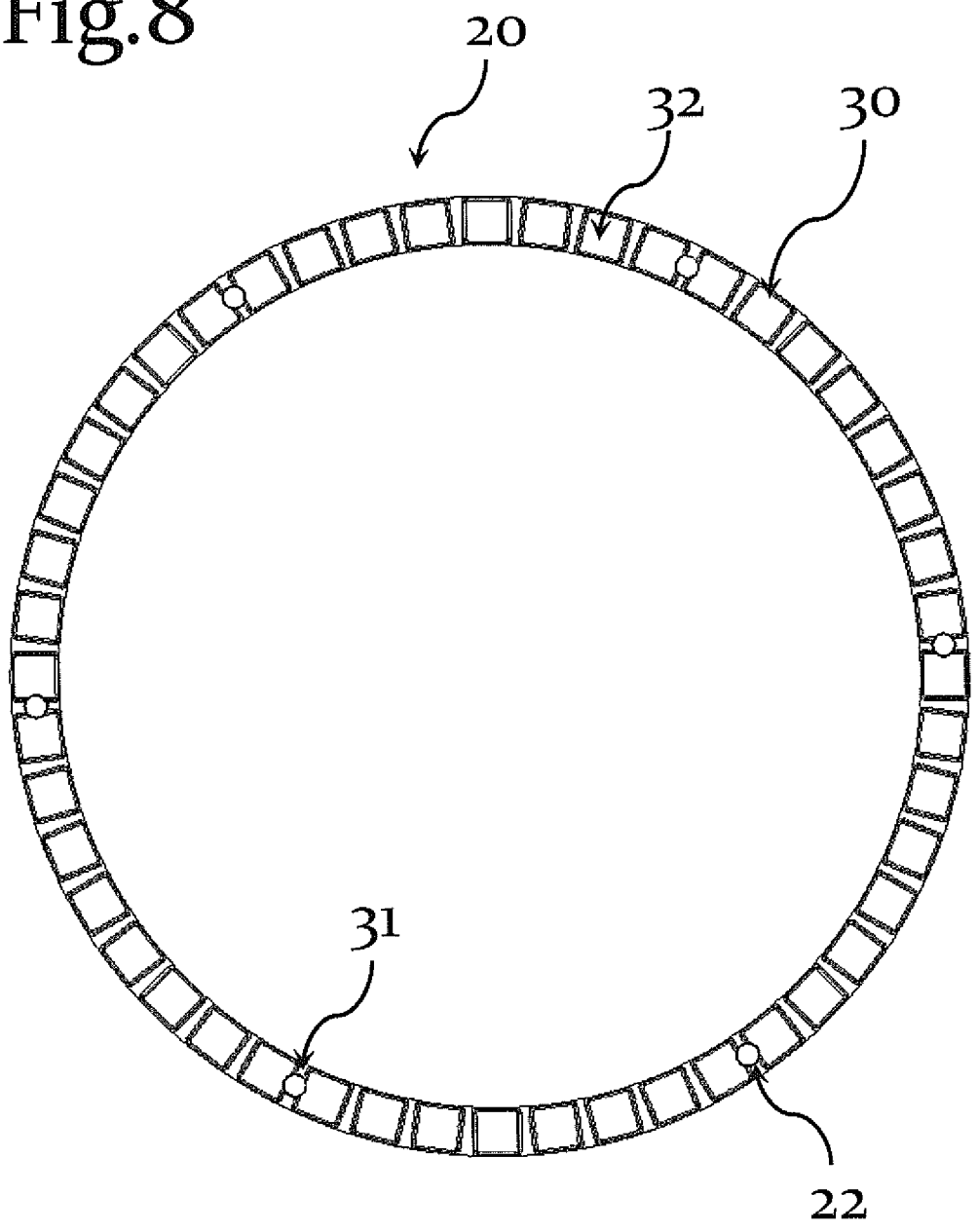
FIG. 8 is an end view of the core end protector absorption section.
Figure 9:
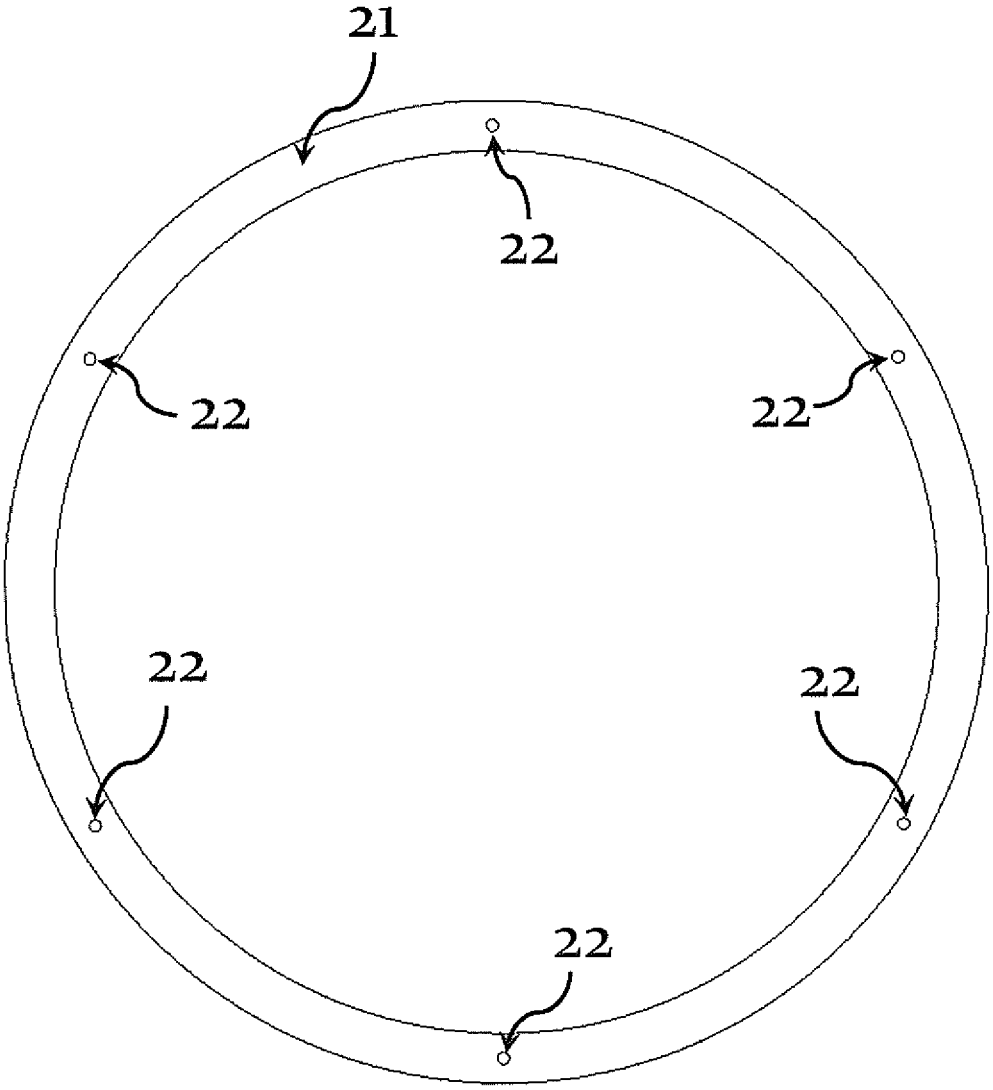
FIG. 9 is an end view of the core protector rigid base section.
Figure 10:
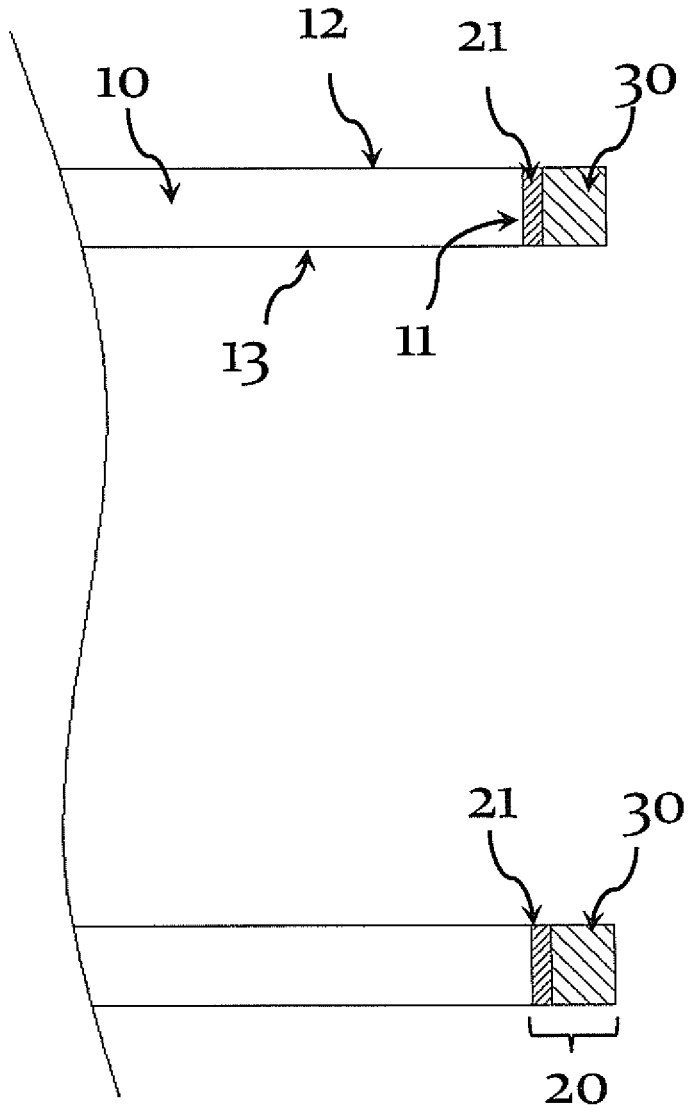
FIG. 10 is a sectional view of the core end protector attached to a cardboard core end.
Figure 11:
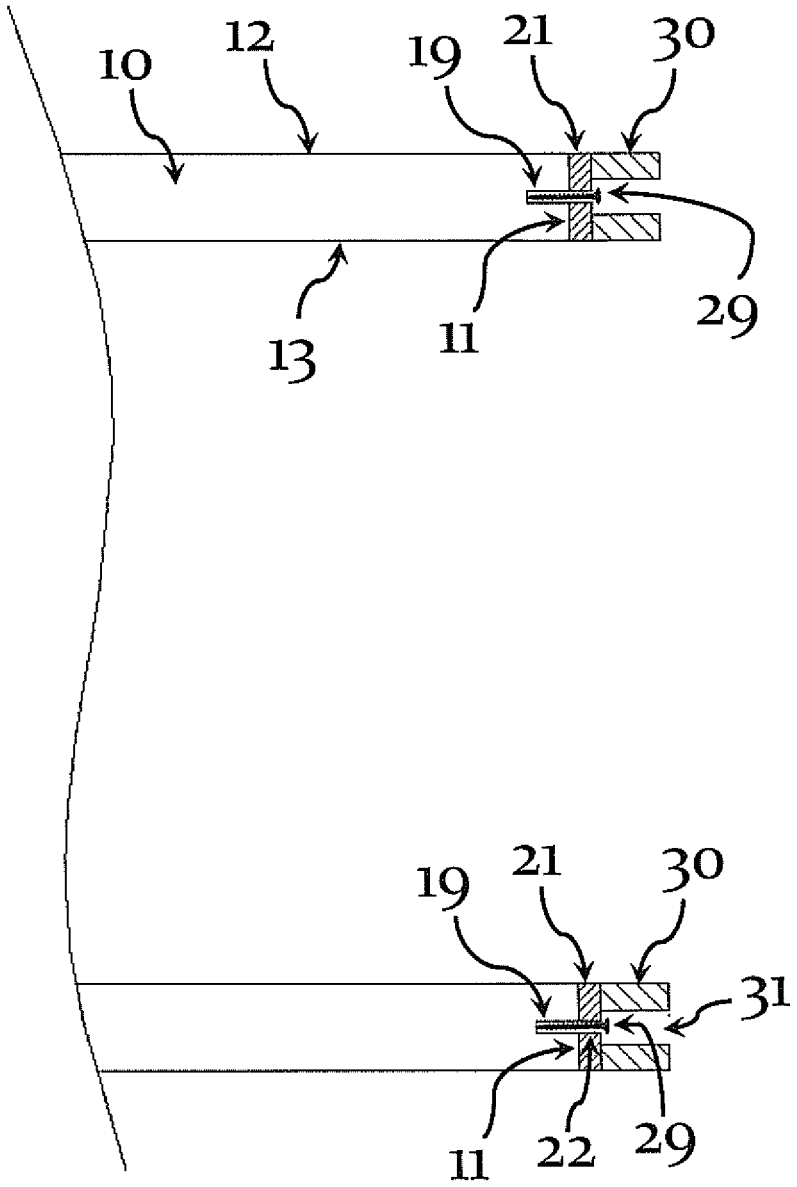
FIG. 11 is a sectional view of the core end protector attached to a cardboard end by means of a screw attachment.
Figure 12:
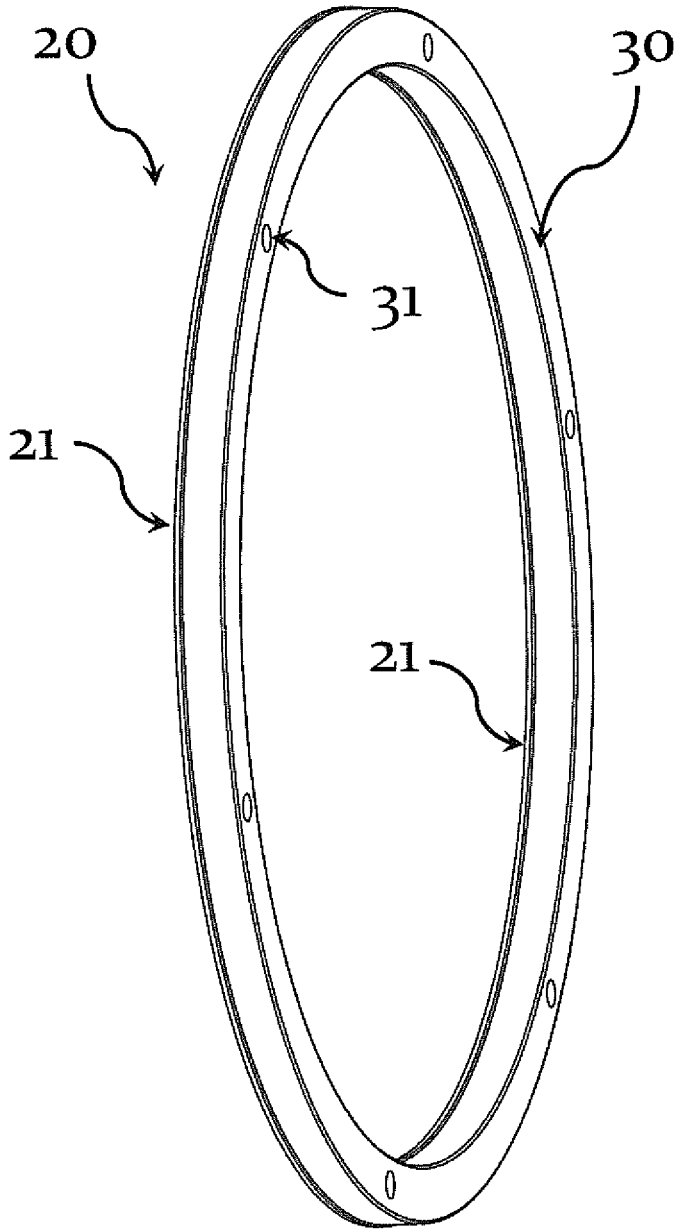
FIG. 12 is a perspective view of a core end protector using one continuous shock absorber geometry.

Referring to the drawings in detail, particularly FIGS. 6-12, wherein like elements are indicated by like numerals there is shown a winding core end protector 20 removably attached to the end 11 of a cardboard core 10. The end protector 20 is annular and generally mirrors the structural annular shape of a core end 11. The end protector external diameter is equal to or slightly less than the external diameter 16 of the cardboard core 10. The internal diameter of the end protector is also approximately equal to the internal diameter of the cardboard core, but not smaller. The end protector 20 is comprised of two sections, an annular, rigid base section 21, and an annular, shock absorbing section 30. The rigid base section 21 mates directly to the core end 11. The softer, shock absorbing section 30 is attached to the base section 21 and comes in contact with external forces and impact loads. One single material or a plurality of materials may be used.

In a preferred configuration, the rigid base section 21 may be made from metal or a high durometer rigid polymer. The rigid base section 21 is intended to spread out an impact load to a larger area on the cardboard core 10, thereby reducing stress concentrations which cause core deformation, delamination and tearing. The rigid base section 21 also provides a non-flexing support for the fasteners 29 to tightly hold the end protector up against the core end 11. The end protector shock absorbing section 30 is made from a softer durometer polymer or elastomeric material (such as urethane or rubber) characterized by surface toughness, overall flexibility upon impact, and high resistance to material creep and compression set under load. If dissimilar materials are used for the base section and shock absorbing section, the shock absorbing section may be bonded to the rigid base section. If molded from similar materials, they may be made in the same mold using two different durometer compounds. The shock absorbing section 30 may be uniform or have a material geometry designed like "nubs" 32 which each flex individually upon impact and then return to its original shape.

The rigid base section 21 has a plurality of holes 22 formed therein, each said hole adapted to receive a fastener 29 to hold the rigid base section 21 directly to the core end 11. Pilot holes 19 may be formed into the core end 11 to assist the fastener insertion into the core. The fasteners 29 do not come in contact with the shock absorbing section 30. The shock absorbing section has a plurality of holes 31 formed therein between the nubs 32 or as cavities in uniform shock absorption material to allow the fasteners to pass through or bypass the shock absorption material and engage the rigid base section 21 with a core end 11.

It is understood that the above-described embodiments are merely illustrative of the application. Other embodiments may be readily devised by those skilled in the art, which will embody the principles of the invention and fall within the spirit and scope thereof. The shock absorbing section geometry can be of any configuration that both effectively absorbs the shock of a drop impact and maintains shape during long term loading conditions without permanent creep. In an optional configuration, the shock absorbing section may be molded directly onto the core end. Alternatively, the shock absorber section may be attached directly to the core end with fasteners, adhesive, bonding, or other suitable attachment means without the rigid section present.

We claim:

1. A winding core end protector, comprising:

an annular, rigid base section mated directly to an end of a winding core;

an annular, shock absorbing section fixedly attached to said rigid base section;

wherein the winding core end protector has an external diameter generally equal to a winding core external diameter, and an internal diameter generally equal to a winding core internal diameter;

wherein the rigid base section is made from a material from the group consisting of metals or high durometer rigid polymers; and wherein the end protector shock absorbing section is made from the group consisting of softer durometer polymers or elastomeric materials, said materials characterized by surface toughness, overall flexibility upon impact, and high resistance to material creep and compression set under load;

wherein the rigid base section has a plurality of holes formed therein, each said hole adapted to receive a fastener to hold the rigid base section directly to the winding core end;

wherein the shock absorbing section has a plurality of cavities to allow said fasteners to pass through and engage the rigid base section with the winding core end;

wherein the shock absorbing section is comprised of a plurality of nubs with a space between each adjacent nub; and a plurality of holes formed between the nubs.

* * * * *